US005966899A

United States Patent [19]

Fontanazzi

[11] Patent Number: 5,966,899

[45] Date of Patent: Oct. 19, 1999

[54] HIGH-SPEED FOLDING UNIT FOR POURABLE FOOD PRODUCT PACKAGING MACHINES

[75] Inventor: Paolo Fontanazzi, Modena, Italy

[73] Assignee: Tetra Laval Holdings & Finance S.A., Pully, Switzerland

[21] Appl. No.: 09/080,216

[22] Filed: May 18, 1998

[30] Foreign Application Priority Data

Jun. 27, 1997 [EP] European Pat. Off. ..... 97830318

[51] Int. Cl.[6] ..... B65B 51/10

[52] U.S. Cl. ..... 53/374.7; 53/375.5; 53/387.2; 53/387.3

[58] Field of Search ..... 53/374.7, 375.2, 53/375.5, 375.7, 387.1, 387.2, 387.3, 387.4

[56] References Cited

U.S. PATENT DOCUMENTS

| | | | |
|---|---|---|---|
| 1,824,401 | 9/1931 | Kellogg et al. . | |
| 3,089,298 | 5/1963 | Neuendorf et al. | 53/370.6 X |
| 3,332,198 | 7/1967 | Thesing . | |
| 3,438,176 | 4/1969 | Reil et al. | 53/375.2 X |
| 3,451,194 | 6/1969 | Nerenberg et al. | 53/375.5 X |
| 3,726,058 | 4/1973 | Stark . | |
| 3,785,113 | 1/1974 | Mårtensson et al. . | |
| 3,999,469 | 12/1976 | Nilsson . | |
| 4,044,528 | 8/1977 | Black et al. | 53/375.2 X |
| 4,509,312 | 4/1985 | Nakajima | 53/375.2 X |
| 4,510,732 | 4/1985 | Löthman . | |
| 4,528,803 | 7/1985 | Ott . | |
| 4,546,592 | 10/1985 | Reil . | |
| 4,614,079 | 9/1986 | Ida et al. | 53/375.3 X |
| 4,776,147 | 10/1988 | Konzal et al. | 53/376.7 X |
| 5,031,385 | 7/1991 | Wada | 53/376.6 X |
| 5,324,250 | 6/1994 | Janson et al. . | |
| 5,836,139 | 11/1998 | Yoshida et al. | 53/387.3 |

FOREIGN PATENT DOCUMENTS

| | | |
|---|---|---|
| 1 020 698 | 2/1953 | France . |
| 5305906 | 11/1993 | Japan . |
| 7205907 | 8/1995 | Japan . |
| 9086505 | 3/1997 | Japan . |
| 9086520 | 3/1997 | Japan . |

*Primary Examiner*—Daniel B. Moon

*Attorney, Agent, or Firm*—Burns, Doane, Swecker & Mathis, L.L.P.

[57] ABSTRACT

A high-speed folding unit (1) for producing, from pillow-pack packets (3), sealed parallelepiped packages (2) containing pourable food products, the unit having a continuous conveyor (21) for feeding the packets (3) along a forming path (B); a number of folding devices (24, 25, 26) located along the forming path (B); a heating device (27) acting on fold portions (15, 16) of each packet (3) to melt and seal the fold portions (15, 16) onto respective walls (12, 11) of the packet (3); and a final pressing device (28) cooperating with each packet (3) to hold the fold portions (15, 16) on the respective walls (12, 11) as the fold portions (15, 16) cool; the folding devices (24, 25, 26) and the final pressing device (28) having a number of interacting members (44, 50, 55, 58, 70, 71, 72) interacting with the packets (3), and which are of fixed size, and cooperate with the packets (3) by virtue of the movement of the conveyor (21).

16 Claims, 4 Drawing Sheets

HIGH-SPEED FOLDING UNIT FOR POURABLE FOOD PRODUCT PACKAGING MACHINES

This application claims priority under 35 U.S.C. §§119 and/or 365 to No. 97830318.8 filed in the EPO on Jun. 27, 1997; the entire content of which is hereby incorporated by reference.

The present invention relates to a high-speed folding unit for packaging machines for continuously producing aseptic sealed packages, containing pourable food products, from a tube of packaging material.

Many pourable food products, such as drinks, fruit juice, pasteurized or UHT (ultra-high-temperature treated) milk, wine, tomato sauce, etc., are sold in packages made of sterilized packaging material.

A typical example of such a package is the parallelepiped packaging container for liquid or pourable food products known by the name of Tetra Brik Aseptic (registered trademark), which is formed by folding and sealing a strip-rolled packaging material.

The rolled packaging material comprises layers of fibrous material, e.g. paper, covered on both sides with thermoplastic material, e.g. polyethylene; and the side of the packaging material eventually contacting the food product in the package also comprises a layer of barrier material, e.g. an aluminium sheet, in turn covered with a layer of thermoplastic material.

As is known, packages of the above type are produced on fully automatic packaging machines, on which a continuous tube is formed from the packaging material supplied in strip form. The strip of packaging material is sterilized on the packaging machine, e.g. by applying a chemical sterilizing agent, such as a hydrogen peroxide solution; following sterilization, the sterilizing agent is removed, e.g. vaporized by heating, from the surfaces of the packaging material; and the strip of packaging material so sterilized is kept in a closed sterile environment, and is folded and sealed longitudinally to form a tube.

The tube is filled with the sterilized or sterile-processed food product, and is sealed at equally spaced cross sections at which it is then cut into pillow-pack packets, which are subsequently folded mechanically to form finished parallelepiped packages.

Packaging machines of the above type are known, in which the pillow-pack packets are folded into parallelepiped packages by folding units substantially comprising a conveyor for feeding the packets in steps along a forming path; a number of folding devices located along the forming path; a heating assembly acting on the portions of each packet to be folded, to melt and seal the portions onto respective walls of the packet; and a final pressing device cooperating with each packet to hold the heat-sealed portions on the respective walls as the portions cool.

More specifically, the folding devices and final pressing device comprise a number of interacting members located along the forming path and movable in steps to and from the conveyor to perform respective forming operations on the packets traveling on the conveyor.

A major drawback of known folding units is the intermittent movement, characterized by successive braking and restarting, to which the conveyor and interacting members are subjected, and which, as the output rate increases, results in sharp deceleration and acceleration of the moving parts, and in dynamic problems over and above a given maximum output rate.

It is an object of the present invention to provide a reliable high-speed folding unit for pourable food product packaging machines, designed to overcome the aforementioned drawback typically associated with known folding units.

According to the present invention, there is provided a high-speed folding unit for machines for packaging pourable food products, the unit comprising:

a supply station for supplying a succession of sealed pillow-pack packets containing said food products, and each having a number of fold portions to be folded and sealed onto respective walls of the packet to form a respective parallelepiped package;

conveying means for feeding said packets along a forming path extending from said supply station to an output station;

folding means located along said forming path and cooperating with each said packet to perform respective folding operations on the packet;

heating means acting on said fold portions of each said packet, to melt and seal said fold portions onto the respective said walls; and final pressing means cooperating with each said packet to hold the respective said fold portions on the respective said walls as the fold portions cool;

characterized in that said conveying means are continuous; and said folding means and said pressing means comprise a number of interacting members interacting with said packets, and which are of fixed size and cooperate with the packets by virtue of the movement of said conveying means.

A preferred, non-limiting embodiment of the present invention will be described by way of example with reference to the accompanying drawings, in which.

Figure 1:
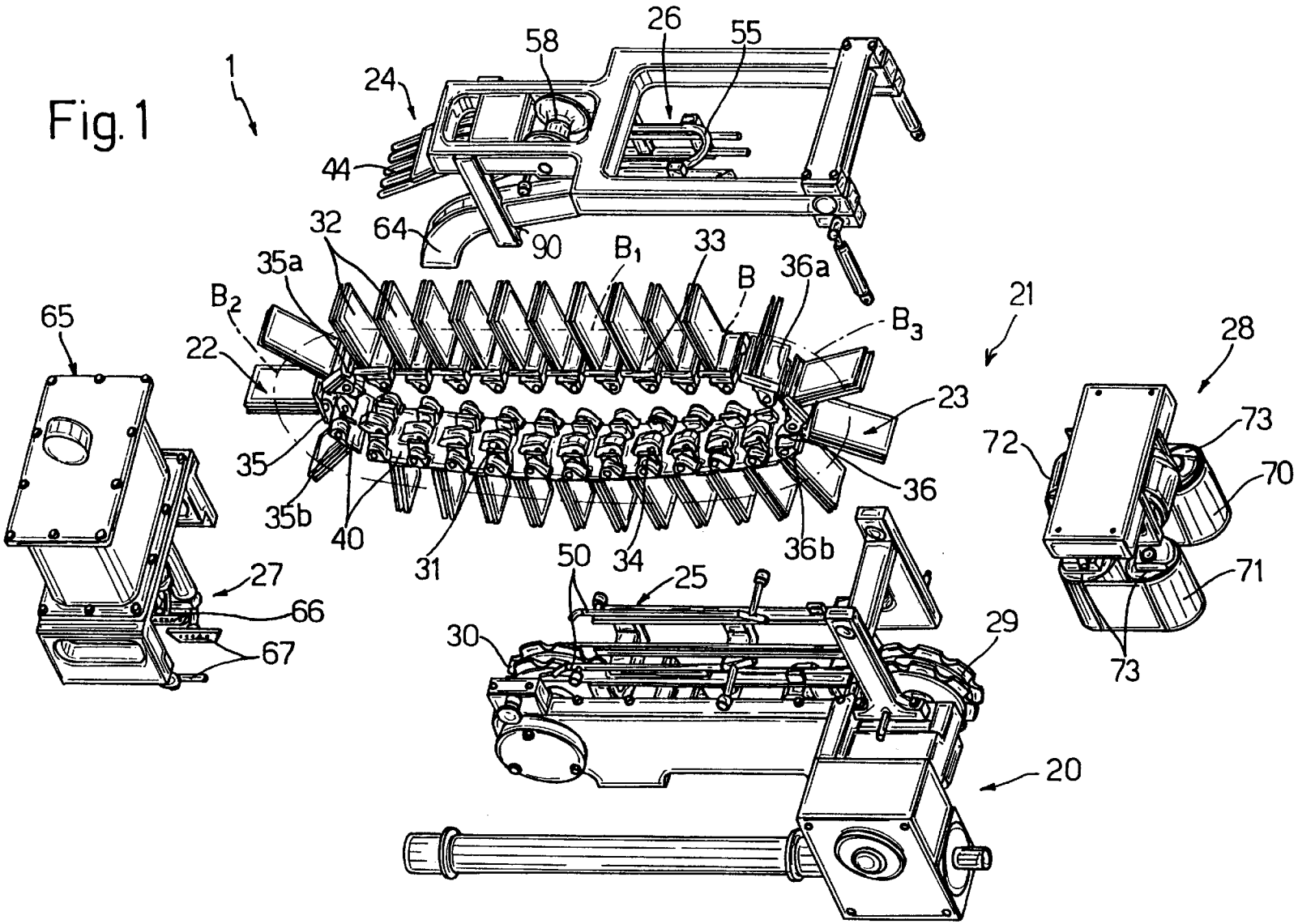
FIG. 1 shows an exploded view in perspective of a high-speed folding unit for pourable food product packaging machines, in accordance with the present invention.
Figure 2:
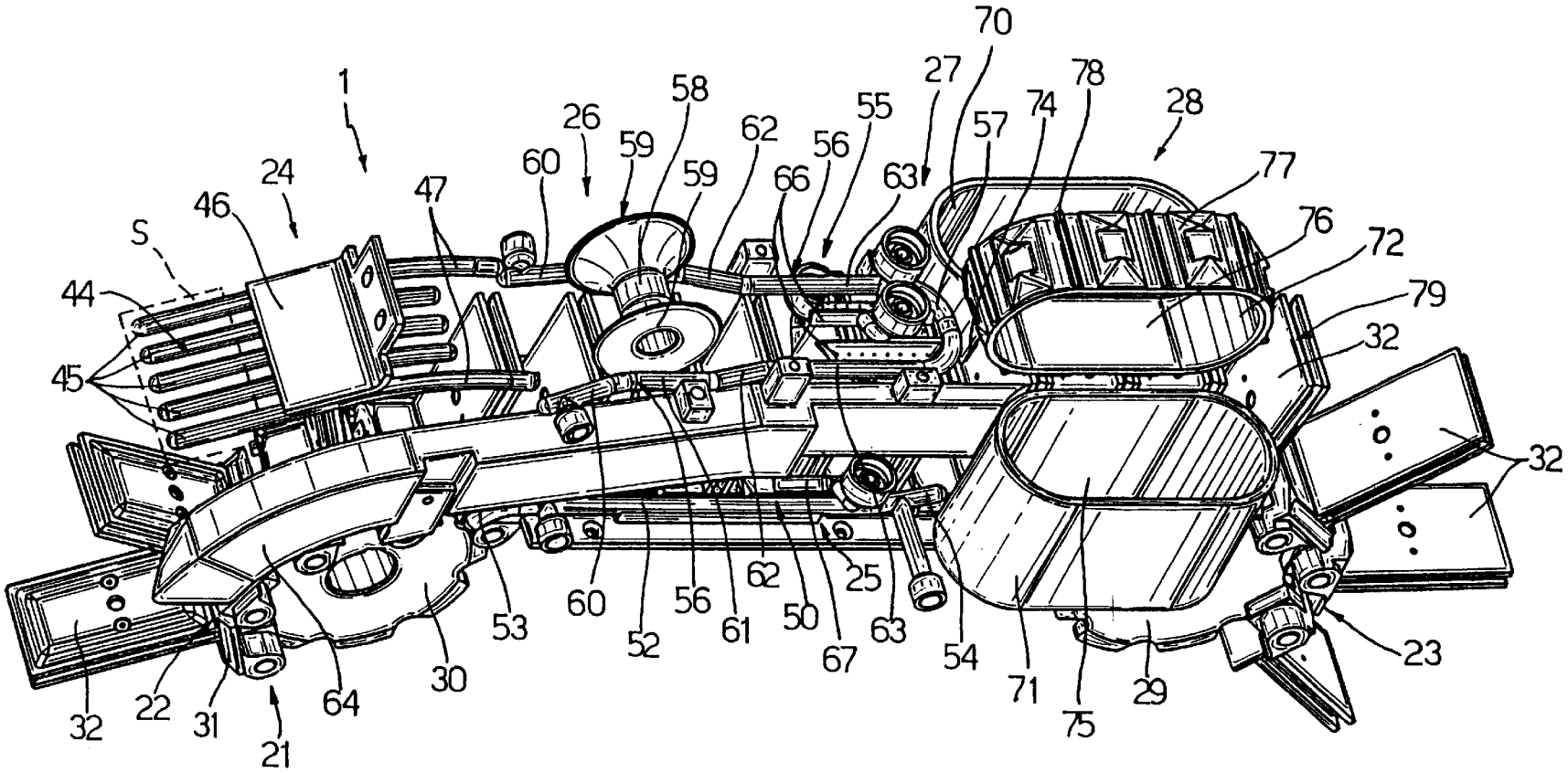
FIG. 2 shows a larger-scale topside view in perspective, with parts removed for clarity, of the FIG. 1 unit.
Figure 3:
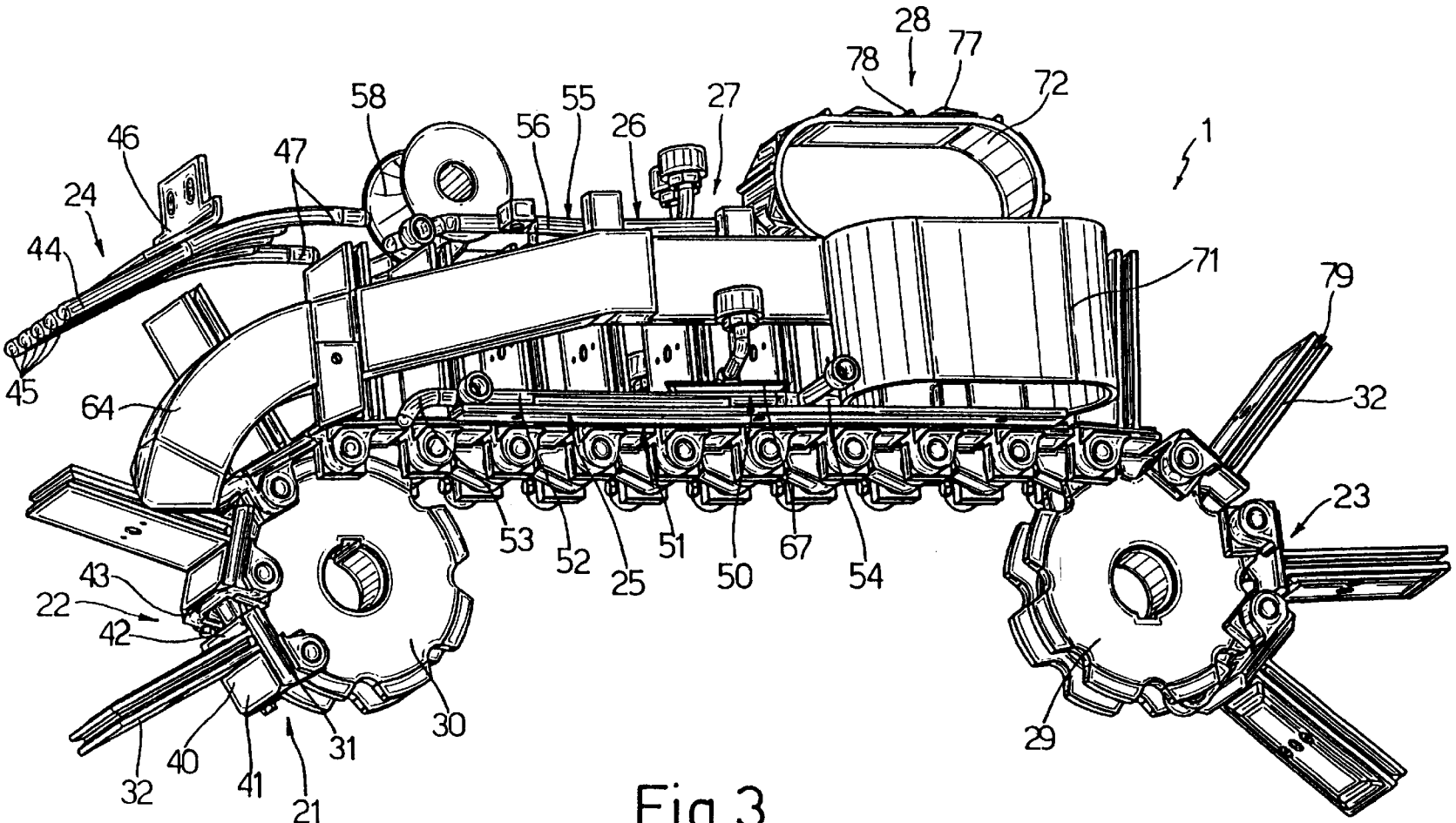
FIG. 3 shows a larger-scale underside view in perspective, with parts removed for clarity, of the FIG. 1 unit.

Number 1 in FIGS. 1 to 3 indicates a high-speed folding unit for a packaging machine (not shown) for continuously producing, from a known tube of packaging material (not shown), sealed aseptic parallelepiped packages 2 (FIG. 8) containing a pourable food product, such as pasteurized or UHT milk, fruit juice, wine, etc.

The tube is formed in known manner upstream from unit 1 by longitudinally folding and sealing a known strip (not shown) of heat-seal sheet material comprising layers of fibrous material, e.g. paper, covered, on the side eventually forming the outside of packages 2, with a layer of thermoplastic material, e.g. polyethylene, and, on the side eventually contacting the food product, with a layer of thermoplastic material and a layer of barrier material, e.g. an aluminium sheet in turn covered with thermoplastic material.

The tube of packaging material is then filled with the food product for packaging, is sealed at equally spaced cross sections, and is cut along the cross sections into a number of pillow-pack packets 3 (FIG. 4), which are then sent to unit 1 where they are folded mechanically to form respective packages 2.

Figure 4:
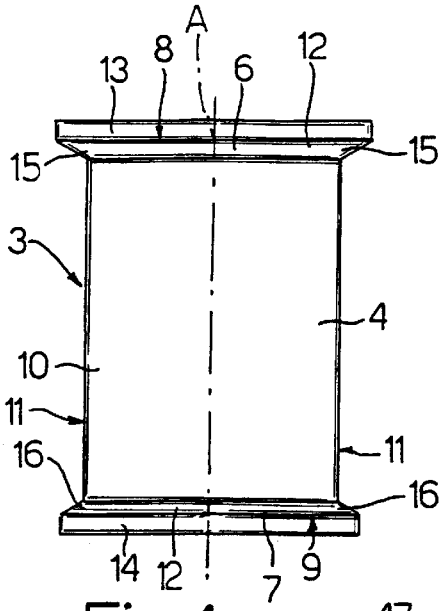
FIGS. 4 to 8 show schematic front views of a preferred sequence performed by the FIG. 1 unit to fold a pillow-pack packet into a parallelepiped package.

With reference to FIG. 4, each packet 3 has an axis A, and comprises a parallelepiped main portion 4, and opposite top and bottom end portions 6, 7 tapering from portion 4 towards respective sealing lines 8, 9, perpendicular to axis A, of packet 3.

More specifically, portion 4 of each packet 3 is defined laterally by a pair of flat rectangular walls 10 parallel to each other, to axis A and to sealing lines 8, 9, and by a pair of flat rectangular walls 11 extending between walls 10.

Each end portion 6, 7 is defined by a pair of walls 12 substantially in the form of an isosceles trapezium, sloping slightly towards each other with respect to a plane perpendicular to axis A, and having shorter edges defined by respective edges of walls 10 of portion 4, and longer edges joined to each other by respective sealing line 8, 9.

Each packet 3 also comprises, for each end portion 6, 7, an elongated substantially rectangular tab 13, 14 projecting from respective sealing line 8, 9; and a pair of substantially triangular portions 15, 16 projecting laterally from opposite sides of portion 4 and defined by end portions of respective walls 12.

To form package 2, unit 1 compresses end portions 6, 7 of packet 3 towards each other, so as to fold respective tabs 13, 14 onto end portions 6, 7, and folds and seals portions 15 of end portion 6 onto respective walls 12, and portions 16 of end portion 7 onto respective walls 11 of portion 4.

With reference to FIGS. 1 to 3, unit 1 comprises a supporting frame 20 (shown broken down into its component elements in FIG. 1); a chain conveyor 21 fitted to frame 20 and for feeding packets 3 continuously along a forming path B from a supply station 22 to an output station 23; a number of folding devices 24, 25, 26 fitted to frame 20 in fixed positions along path B and cooperating with packets 3 to perform respective folding operations on the packets; a heating device 27 acting on portions 15, 16 of packet 3 to be folded, to melt and seal portions 15, 16 onto respective walls 12, 11; and a final pressing device 28 cooperating with each packet 3 to hold portions 15, 16 on respective walls 12, 11 as portions 15, 16 cool.

More specifically, conveyor 21 comprises at least one gear, and in the example shown a drive gear 29 and a driven gear 30; and an articulated chain 31 looped about and meshing with gears 29, 30, and fitted with a number of flat rectangular blades 32, each of which projects from chain 31, and cooperates with and pushes a corresponding wall 10 of a respective packet 3 to feed the packet along path B.

More specifically, chain 31 comprises a straight horizontal top branch 33; a bottom branch 34 substantially parallel to branch 33; and two curved C-shaped portions 35, 36 arranged with their concavities facing each other, connecting branches 33, 34, and the middle portions of which respectively define supply station 22 and output station 23.

Path B comprises a straight main portion B1 defined by branch 33 of chain 31; and two respectively supply and output end portions B2, B3 defined by respective top portions 35*a*, 36*a* of portions 35, 36 of chain 31 extending between corresponding stations 22, 23 and branch 33. Branch 33 and portions 35*a*, 36*a* of portions 35, 36 therefore define a conveying branch of chain 31 for feeding packets 3 from station 22 to station 23; while branch 34 and the remaining portions 35*b*, 36*b* of portions 35, 36 define a return branch of chain 31 for feeding blades 32 from station 23 to station 22.

Chain 31 comprises a number of articulated links 40 defined by flat rectangular plates from which respective blades 32 extend perpendicularly. More specifically, each blade 32 extends asymmetrically from respective link 40, and divides link 40 into two rectangular portions 41, 42 of different lengths along path B and respectively located upstream and downstream from blade 32 along path B. More specifically, portion 41 is longer than portion 42 along path B.

Each link 40 is also spaced slightly with respect to the adjacent links 40, with which it defines respective gaps 43 for the purpose described later on.

By virtue of the structure of conveyor 21, blades 32 are positioned vertically along portion B1 of path B and horizontally at stations 22, 23.

Each packet 3 is positioned on conveyor 21 with end portion 7 contacting the conveying branch of chain 31, with one of walls 10 resting on respective blade 32, and with axis A parallel to blade 32, so that portions 15, 16 of each packet 3 extend crosswise to path B.

Packets 3 are also fed onto conveyor 21 in a horizontal input position wherein end portion 7 contacts portions 42, 41 of adjacent links 40, and tab 14 is inserted loosely inside respective gap 43. Similarly, each finished package 2 is removed from conveyor 21 in a horizontal output position.

Folding device 24 comprises an elongated guide member 44 fitted to frame 20 in a fixed position facing and over the conveying branch of chain 31, extending at the portion connecting portions B1 and B2 of path B, and defining, towards chain 31, a concave contrast surface S converging towards the conveying branch and cooperating in sliding manner with end portion 6 of each packet 3 to compress and flatten end portion 6 towards chain 31.

Guide member 44 comprises a number of parallel elongated curved sections 45 connected rigidly to one another by a connecting element 46 crosswise to sections 45; and the sections 45 extending at the lateral ends of guide member 44 comprise respective end portions 47 projecting longitudinally towards station 23 with respect to the other sections 45.

Folding device 25 comprises a pair of contrast elements 50 defined by parallel elongated sections, fitted to frame 20 adjacent to respective opposite lateral edges 51 of branch 33 of chain 31, and cooperating in sliding manner with end portion 7 of each packet 3 to fold tab 14 onto respective walls 12, and portions 16 onto respective walls 11 of portion 4 of packet 3.

More specifically, each contrast element 50 comprises a straight intermediate portion 52 parallel to branch 33 of chain 31; a curved upstream portion 53 extending towards branch 33 from intermediate portion 52; and a curved downstream portion 54 extending from intermediate portion 52 towards a guide member 55 of folding device 26, placed over folding device 25.

Upstream portions 53 of contrast elements 50 cooperate in sliding manner with end portion 7 of each packet 3 to fold portions 16 towards respective walls 11 of packet 3, after first folding tab 14 onto respective walls 12 by means of elements 90; intermediate portions 52 of contrast elements 50 cooperate in sliding manner with portions 16 of each packet 3 to keep portions 16 facing respective walls 11 of packet 3; and downstream portions 54 cooperate in sliding manner with portions 16 to bring them into contact with walls 11.

Guide member 55 is defined by an elongated substantially U-shaped section, is fitted to frame 20 in a position facing and over branch 33 of chain 31, extends downstream from guide member 44 along path B, and cooperates with portions 15 of end portion 6 of packet 3 to fold them onto respective walls 12.

Guide member 55 comprises a pair of elongated contrast arms 56 extending substantially over respective contrast elements 50 and respective lateral edges 51 of branch 33 of chain 31; and a connecting portion 57 crosswise to path B and connecting respective downstream ends of arms 56.

Folding device 26 also comprises a forming roller 58 having an axis perpendicular to path B, fitted idly to frame 20 between arms 56 of guide member 55, and having opposite circular end surfaces 59 facing arms 56 and defining, with arms 56, respective seats in which portions 15 of each packet 3 slide.

Arms 56 comprise, along path B, first guide portions 60 diverging with respect to branch 33 of chain 31, and converging with each other to rotate portions 15 of each packet 3 towards each other; second guide portions 61 parallel to each other and to branch 33, and positioned facing respective end surfaces 59 of roller 58 to hold portions 15 in contact with end surfaces 59; third guide portions 62 parallel to branch 33 and converging towards each other to fold portions 15 towards end portion 6 of packet 3; and fourth guide portions 63 parallel to each other and to branch 33, and for maintaining portions 15 in the position assumed at the output of third guide portions 62. Finally, portion 57 of guide member 55 cooperates in sliding manner with portions 15 of each packet 3 to bring them into contact with end portion 6 of packet 3.

With reference to FIGS. 2 and 3, frame 20 comprises a pair of fixed sides 64 (only one shown) for laterally retaining packets 3 along path B, located on opposite sides of the conveying branch of chain 31, and extending between station 22 and final pressing device 28, which is located immediately downstream from folding devices 25, 26 along path B.

With reference to FIGS. 1 to 3, heating device 27 comprises an air heating assembly 65 fitted to frame 20; a pair of first nozzles 66 connected to assembly 65 and located between guide portions 63 of arms 56 to direct hot air onto portions 15 of each packet 3 before portions 15 reach portion 57 of guide member 55; and a pair of second nozzles 67 connected to assembly 65 and located between intermediate portions 52 of contrast elements 50 to direct hot air onto portions 16 of each packet 3 before portions 16 reach downstream portions 54 of contrast elements 50.

Final pressing device 28 comprises three endless belts 70, 71, 72, which are fitted to respective pairs of pulleys 73 in turn fitted idly to frame 20, are positioned at 90° to one another, and define, between them and together with branch 33 of chain 31, a forming passage (indicated P1 in FIG. 8) having a constant rectangular section, and defining the outer contour of the finished packages 2 coming off unit 1. In the example shown, belts 70, 71, 72 and respective pulleys 73 are fitted to a top portion of frame 20, but may alternatively be fitted to a bottom portion of frame 20.

More specifically, two of said belts (70, 71) are located on opposite sides of branch 33 of chain 31, and comprise respective smooth active branches 74, 75 facing each other, perpendicular to branch 33, and extending substantially along extensions of respective sides 64.

Belt 72 is located over blades 32, and comprises an active branch 76 parallel to branch 33 of conveyor 21 and perpendicular to active branches 74, 75 of belts 70, 71.

On the outside, belt 72 comprises a number of shaped equally spaced projections 77 cooperating in sliding manner with portions 15 of each packet 3 to compress portions 15 on the by now flat end portion 6 of packet 3.

On the outside, belt 72 also comprises a number of elongated projections 78 perpendicular to path B, interposed between shaped projections 77, and which, as conveyor 21 advances, mate with respective elongated openings 79 formed on the free end edges of respective blades 32 to synchronize the movement of belt 72 with chain 31. Alternatively, belts 70, 71 may be formed in the same way as belt 72, with projections similar to projections 77, 78.

As will be clear from the foregoing description, according to an important characteristic of the present invention, guide members 44, 55, contrast elements 50, roller 58 and belts 70, 71, 72 are all of fixed size and cooperate with packets 3 by virtue of the movement of conveyor 21.

Operation of unit 1 will now be described with reference to one packet 3, and as of the instant in which packet 3 is fed onto a respective blade 32 of conveyor 21 in the horizontal input position with tab 14 of end portion 7 engaging respective gap 43.

Figure 5:
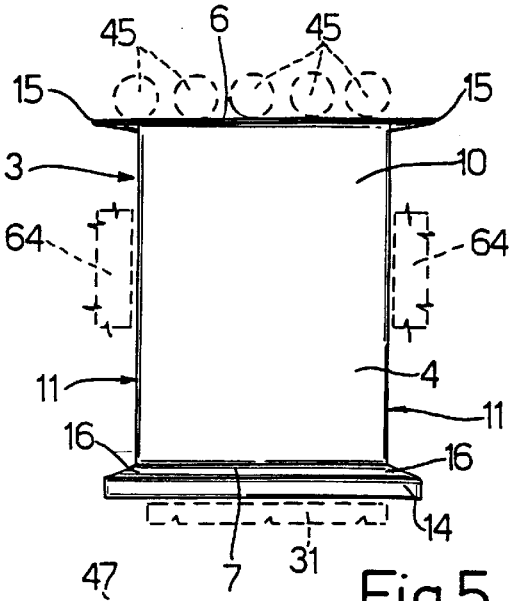

By virtue of the movement and the thrust exerted by blade 32, packet 3 is tilted along portion B2 of path B and eventually up-ended into a vertical position at the start of portion B1 of path B; during which movement, end portion 6 of packet 3 cooperates in sliding manner with guide member 44, which, as described, has a profile converging towards chain 31 and so compresses and flattens end portion 6 (FIG. 5).

Figure 6:
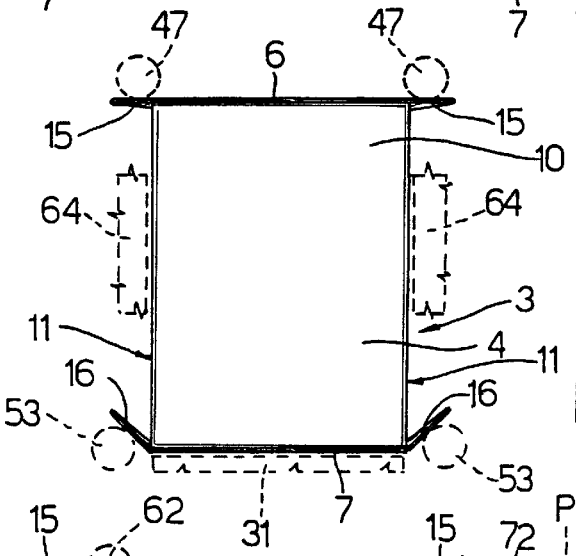

As, or shortly after, end portion 6 of packet 3 approaches end portions 47 of sections 45, end portion 7 of packet 3 contacts upstream portions 53 of contrast elements 50; as packet 3 slides against element 90, tab 14 is folded onto end portion 7, and end portion 7 is flattened; and, as packet 3 slides along portions 53 of contrast elements 50, portions 16 are rotated towards respective walls 11 of packet 3 (FIG. 6).

Figure 7:
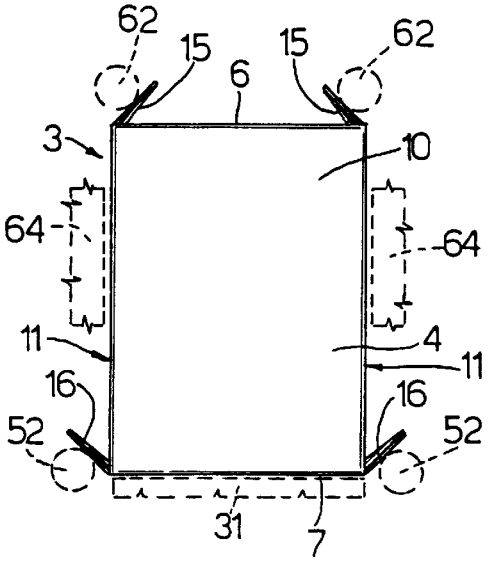

Subsequently, portions 15 of end portion 6 of packet 3 reach guide portions 60 of arms 56, where they are rotated upwards into a vertical position parallel to each other; at which point, portions 15 are fed between guide portions 61 of arms 56 and end surfaces 59 of forming roller 58, and are folded further towards walls 12 of end portion 6 by guide portions 62 of arms 56 (FIG. 7).

As packet 3 travels between guide portions 63 of arms 56 and between intermediate portions 52 of contrast elements 50, nozzles 66, 67 direct hot air onto respective portions 15, 16 to partly and locally melt the layer of thermoplastic material covering portions 15, 16; and, as packet 3 slides beneath portion 57 of guide member 55 and between downstream portions 54 of contrast elements 50, portions 15, 16 are finally folded onto respective walls 12, 11.

Figure 8:
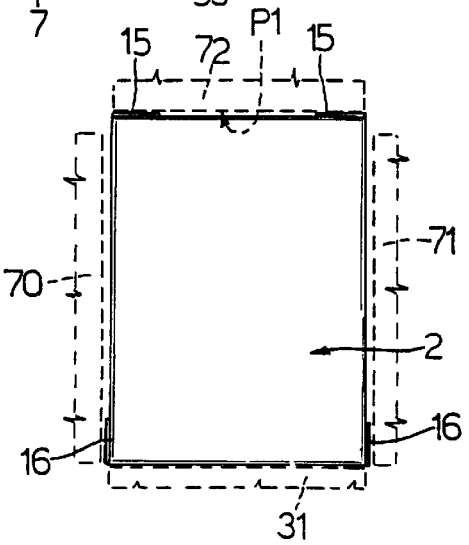

Finally, packet 3 is pushed by the movement of conveyor 21 through the passage P1 defined by branch 33 of conveyor 21 and by active branches 74, 75, 76 of belts 70, 71, 72, and inside which, portions 15, 16 cool and are sealed, by virtue of the pressure exerted on them, to respective walls 12, 11 to form the finished package 2 (FIG. 8).

The advantages of unit 1 according to the present invention will be clear from the foregoing description.

In particular, the continuous operation of unit 1 solves the dynamic problems caused by the sharp acceleration and deceleration to which the moving parts of step-operated systems are subjected, and therefore provides for achieving high output rates (e.g. 8000–24000 packages an hour).

Moreover, unlike known folding units, unit 1 features only one powered member, i.e. conveyor 21, which therefore simplifies and provides for greater reliability of the control system of unit 1, and hence of the packaging machine on which unit 1 is installed.

Finally, unit 1 is highly compact by virtue of the members interacting with packet 3 (44, 50, 55, 58, 70, 71, 72) all being fitted substantially on conveyor 21.

Clearly, changes may be made to unit 1 as described and illustrated herein without, however, departing from the scope of the claims.

I claim:

1. A high-speed folding unit (1) for machines for packaging pourable food products, the unit comprising:

a supply station (22) for supplying a succession of sealed pillow-pack packets (3) containing said food products, and each having a number of fold portions (15, 16) to be folded and sealed onto respective walls (12, 11) of the packet (3) to form a respective parallelepiped package (2);

conveying means (21) for feeding said packets (3) along a forming path (B) extending from said supply station (22) to an output station (23);

folding means (24, 25, 26) located along said forming path (B) and cooperating with each said packet (3) to perform respective folding operations on the packet (3);

heating means (27) acting on said fold portions (15, 16) of each said packet (3), to melt and seal said fold portions (15, 16) onto the respective said walls (12, 11); and final pressing means (28) cooperating with each said packet (3) to hold the respective said fold portions (15, 16) on the respective said walls (12, 11) as the fold portions (15, 16) cool;

characterized in that said conveying means (21) are continuous; and said folding means (24, 25, 26) and said pressing means (28) comprise a number of interacting members (44, 50, 55, 58, 70, 71, 72) interacting with said packets (3), and which are of fixed size and cooperate with the packets (3) by virtue of the movement of said conveying means (21).

2. A unit as claimed in claim 1, characterized in that said conveying means comprise an endless conveyor (21), in turn comprising a number of push elements (32) for respective said packets (3), a conveying branch (33, 35*a*, 36*a*) for feeding said push elements (32) and said packets (3) along said forming path (B), and a return branch (34, 35*b*, 36*b*) for feeding said push elements (32) from said output station (23) to said supply station (22).

3. A unit as claimed in claim 2, for folding pillow-pack packets (3), each comprising a substantially parallelepiped main portion (4), a first end portion (7) tapering from said main portion (4) towards a respective sealing line (9) and positioned contacting said conveying branch (33, 35*a*, 36*a*), and an opposite second end portion (6) also tapering from said main portion (4) towards a respective sealing line (8); each said packet (3) comprising, for each said end portion (6, 7), a pair of said fold portions (15, 16) projecting laterally from opposite sides of said main portion (4) and crosswise to said forming path (B);

characterized in that said interacting members of said folding means (24, 25, 26) comprise an elongated first guide member (44) facing said conveying branch (33, 35*a*, 36*a*), extending at an upstream portion of said forming path (B), and defining a contrast surface (S) converging towards said conveying branch (33, 35*a*, 36*a*) and cooperating in sliding manner with said second end portion (6) of each said packet (3) to flatten said second end portion (6).

4. A unit as claimed in claim 3, characterized in that said first guide member (44) comprises a number of fixed, parallel, elongated elements (45) extending in the same direction as said forming path (B).

5. A unit as claimed in claim 3, characterized in that said interacting members of said folding means (24, 25, 26) comprise:

a pair of fixed first contrast elements (56) defined by elongated sections, located downstream from said first guide member (44) along said forming path (B), spaced with respect to said conveying branch (33, 35*a*, 36*a*), and facing respective opposite lateral edges (51) of the conveying branch (33, 35*a*, 36*a*); and a pair of fixed second contrast elements (50) defined by elongated sections and located adjacent to respective said lateral edges (51) of said conveying branch (33, 35*a*, 36*a*); said first and said second contrast elements (56, 50) respectively cooperating in sliding manner with said second end portion (6) and said first end portion (7) of each said packet (3) to fold the respective said fold portions (15, 16).

6. A unit as claimed in claim 5, characterized in that said first contrast elements (56) define respective arms of a substantially U-shaped second guide member (55) comprising a connecting portion (57) crosswise to said forming path (B) and connecting respective downstream ends of the first contrast elements (56); said interacting members of said folding means (24, 25, 26) comprising a forming roller (58) interposed between said first contrast elements (56), having an axis perpendicular to said forming path (B), and having opposite end surfaces (59) facing said first contrast elements (56) and defining, with the first contrast elements (56), respective seats in which respective said fold portions (15) of each said packet (3) slide.

7. A unit as claimed in claim 6, characterized in that said first contrast elements (56) comprise, along said forming path (B), first guide portions (60) diverging with respect to said conveying branch (33, 35*a*, 36*a*) and converging with each other to rotate respective said fold portions (15) of each said packet (3) towards each other; second guide portions (61) parallel to each other and to said conveying branch (33, 35*a*, 36*a*) and facing respective said end surfaces (59) of said forming roller (58) to hold said fold portions (15) on said end surfaces (59); third guide portions (62) parallel to said conveying branch (33, 35*a*, 36*a*) and converging with each other to fold said fold portions (15) towards said second end portion (6) of said packet (3); and fourth guide portions (63) parallel to each other and to said conveying branch (33, 35*a*, 36*a*) to hold said fold portions (15) in the position assumed at the output of said third guide portions (62); said connecting portion (57) of said second guide member (55) cooperating in sliding manner with the respective said fold portions (15) of each said packet (3) to bring the fold portions (15) into contact with said second end portion (6) of the packet (3).

8. A unit as claimed in claim 5, characterized in that said second contrast elements (50) are parallel to each other, and each comprise a straight intermediate portion (52) parallel to said conveying branch (33, 35*a*, 36*a*); a curved upstream portion (53) extending towards said conveying branch (33, 35*a*, 36*a*) from said intermediate portion (52); and a curved downstream portion (54) extending towards said second guide member (55) from said intermediate portion (52); said upstream portions (53) of said second contrast elements (50) cooperating in sliding manner with said first end portion (7) of each said packet (3) to rotate the respective said fold portions (16) towards respective opposite said walls (11) of said main portion (4) of the packet (3); and said downstream portions (54) of said second contrast elements (50) cooperating in sliding manner with the respective said fold portions (16) of each said packet (3) to bring the fold portions (16) into contact with the respective said walls (11) of said main portion (4) of the packet (3).

9. A unit as claimed in claim 2, characterized by comprising a pair of fixed sides (64) for laterally retaining said packets (3), located on opposite sides of said conveying branch (33, 35*a*, 36*a*), and extending between said supply station (22) and said final pressing means (28).

10. A unit as claimed in claim 8, characterized in that said heating means (27) comprise an air heating assembly (65); a pair of first nozzles (66) connected to said heating assembly (65) and located between the fourth guide portions (63) of said first contrast elements (56) to direct hot air onto respective said fold portions (15) of each said packet (3) before the fold portions (15) reach the connecting portion (57) of said second guide member (55); and a pair of second nozzles (67) connected to said heating assembly (65) and located between said intermediate portions (52) of said second contrast elements (50) to direct hot air onto respective said fold portions (16) of each said packet (3) before the fold portions (16) reach said downstream portions (54) of said second contrast elements (50).

11. A unit as claimed in claim 2, characterized in that said interacting members of said final pressing means (28) comprise three endless belts (70, 71, 72) positioned at 90° to one another and defining, between them and together with said conveying branch (33, 35*a,* 36*a*), a forming passage (P1) having a constant rectangular section and defining the outer contour of the finished said packages (2).

12. A unit as claimed in claim 11, characterized in that each of said belts (70, 71, 72) is fitted to a respective pair of idle pulleys (73).

13. A unit as claimed in claim 11, characterized in that a first (70) and a second (71) of said belts are located on opposite sides of said conveying branch (33, 35*a,* 36*a*), and comprise respective active branches (74, 75) facing said conveying branch (33, 35*a,* 36*a*); and in that a third (72) of said belts comprises an active branch (76) perpendicular to said active branches (74, 75) of said first and second belts (70, 71) and facing and parallel to said conveying branch (33, 35*a,* 36*a*).

14. A unit as claimed in claim 13, characterized in that at least one (72) of said belts (70, 71, 72) comprises a number of equally spaced first engaging elements (78) which, as said conveyor (21) advances, releasably engage second engaging elements (79) on respective said push elements (32) to synchronize the movement of the belt (72) with said conveying branch (33, 35*a,* 36*a*) of said conveyor (21).

15. A unit as claimed in claim 14, characterized in that said first engaging elements comprise respective elongated projections (78) crosswise to said forming path (B) and projecting from said third belt (72); and in that said second engaging elements comprise respective elongated openings (79) formed on the free end edges of respective said push elements (32).

16. A unit as claimed in claim 13, characterized in that said third belt (72) comprises, externally, a number of shaped projections (77) cooperating in sliding manner with respective said fold portions (15) of each said packet (3) to compress the fold portions (15) on said second end portion (6) of the packet (3) and define a respective substantially flat or concave wall of said finished package (2).

* * * * *